US005904607A

United States Patent [19]

Abadi

[11] Patent Number: 5,904,607

[45] Date of Patent: May 18, 1999

[54] CLEAVAGE ENHANCEMENT BRASSIERE

[76] Inventor: Jacob Abadi, 1000 W. Island Blvd., Apt.#2409, North Miami Beach, Fla. 33160

[21] Appl. No.: 08/878,573

[22] Filed: Jun. 19, 1997

[51] Int. Cl.[6] ..... A41C 1/00; A41C 1/02; A41C 1/12

[52] U.S. Cl. ..... 450/3; 450/19; 450/48; 450/53; 2/73

[58] Field of Search ..... 2/73, 105, 106, 2/259, 260, 260.1, 261, 262, 263, 264, 256, 67; 450/3, 4, 6, 8, 19, 20, 21, 23, 27, 48, 53, 54, 55, 56, 66, 88, 74, 75, 76, 70, 92, 41, 42, 43, 44, 45, 46, 47, 49, 50, 51, 52

[56] References Cited

U.S. PATENT DOCUMENTS

| | | | |
|---|---|---|---|
| 1,999,010 | 4/1935 | Tait | 2/88 |
| 2,045,401 | 6/1936 | Mowry . | |
| 3,090,387 | 5/1963 | Hopper | 450/74 |
| 3,173,421 | 3/1965 | Steiner | 450/74 |
| 3,814,107 | 6/1974 | Greenblatt et al. . | |
| 3,827,441 | 8/1974 | Rudolph . | |
| 4,983,140 | 1/1991 | Gimble | 450/27 |

FOREIGN PATENT DOCUMENTS

| | | | |
|---|---|---|---|
| 1004672 | 4/1952 | France | 450/48 |
| 0385554 | 12/1923 | Germany | 450/88 |

*Primary Examiner*—Jeanette Chapman
*Attorney, Agent, or Firm*—Law Practice of Scott L. Lampert, P.A.; Scott L. Lampert

[57] ABSTRACT

A brassiere for enhancing cleavage between the breasts of a wearer and including a torso shaping body member, which can be worn under a garment which is strapless, off the shoulder and/or cut low in the back. The present invention comprises a pair of breast cups disposed in spaced apart yet communicating relation with one another. Each breast cup preferably includes an upper half and a lower half and an underwire which is structured and disposed to wrap substantially around each breast of the wearer so as to effectively lift the breasts upwardly. As a unique feature, the improved brassier of the present invention includes a tensioner member interposed between the breast cups and preferably, which has a generally "V" shape, so as to effectively squeeze the breasts together. The present invention additionally comprises a body member, with optional straps for securing the brassier about the torso of the wearer in proper orientation so that the breast cups are disposed to support the wearer's breasts. Preferably, the body member is structured to extend down to the waist region and about the torso of the wearer, and includes a plurality of panels structured to give the wearer an athletic "V" shape appearance. Additionally, each breast cup includes a strap coupling at an upper and outwardly point thereof for allowing a strap to be attached to one of the couplings, wrapped under the arms and around the back of the wearer and to be attached to the other of the couplings.

14 Claims, 2 Drawing Sheets

CLEAVAGE ENHANCEMENT BRASSIERE

BACKGROUND OF THE INVENTION

1. Field of the Invention

The present invention relates generally to the field of under garments, and more specifically to a cleavage enhancement brassiere with a torso shaping section. The present invention is structured and disposed to greatly enhance the torso and bust-line of the wearer while simultaneously offering an ability to be worn under a garment which is strapless, off the shoulder and/or cut low in the back. The brassiere of the present invention is also structured and disposed to result in a smooth continuous appearance under any of the vast array of patterns and materials utilized in today's clothing fashions.

2. Description of the Related Art

Over the years, the brassiere has undergone many changes. For example, while the brassier was at one time a method of concealment it has more recently become a tool to enhance the shapeliness of the wearer. This has been evidenced in recent years by the extreme popularity of cleavage enhancing bras and brassieres. Even so, presently available brassieres which are designed to enhance a wearer's cleavage are either not structured to be worn or unable to work effectively when worn under certain elegant, stylish and/or cool garments which are strapless or which offer a low cut or bare-back look. As such types of dresses and other garments are also quite popular, there remains a great need in the art for a brassiere that not only enhances the wearer's cleavage, but which further, can effectively do so without the use of straps about the shoulders or while having a low cut on the wearer's back side.

In the past, undergarments employed various techniques to improve the bust line of the wearer. For example, U.S. Pat. No. 3,595,243 issued to Mount describes a brassiere constructed to positively and mechanically elevate or lift up the breasts of the user when the brassiere is secured around the chest. The '243 patent provides an uplift system which operates independently for each breast in that the patent device uses tension created by two separate independent stays, which lift each breast independently upward of each other. This patented device is thought to be insufficient however, in that the breasts are not pushed together so as to enhance cleavage. It would be better to provide a brassiere that works as an uplifting system that not only brings the breasts up but together. Similarly, in the U.S. Pat. No. 2,866,462 (the '462 patent) issued to E. Faron, describing an up-lift brassiere, the uplifting method for each breast is separate, instead of one continuous system. The limitations of both the '243 patent and the '462 patent do not enable the patented devices to effectively support the breasts in a manner that brings the breasts to an upwardly and inwardly point. Moreover, it is believed that the patented devices cannot be adjusted to achieve varying enhancement of the cleavage.

Several brassieres known in the art utilize various inserts and bindings to achieve the enhancement of the wearer's cleavage. However, many of these devices are uncomfortable to the wearer and further, have resulted in surface irregularities such as one or more bumps or protrusions, that are visible and highly noticeable, even through the wearer's clothing or outer garments. Thus, there remains a need in the art for a brassiere that not only enhances the wearer's cleavage, but further, which is comfortable to wear and which will not cause any surface irregularities that would be visible through a wearer's clothing or outer garments.

Others in the art have also attempted to provide a brassiere or corselet which would offer the wearer a more flattering appearance to her torso region. One such attempt is taught in U.S. Pat. No. 2,739,312 issued to Morano. It is logical, however, that this patented devices, as well as other similar efforts, almost undoubtedly led to the bulging of the flesh in some undesirable areas of the torso because the devices were overly constrictive and did not consider what was a suitable amount of pressure to shape the figure, without sacrificing comfort. Furthermore, the modern desirable shape of the torso region is that which has an athletic "V" -shape. Many of the past torso enhancers, however, commonly known as girdles, only acted to constrict the torso region overall and did not offer the wearer a more athletic or "V" shaped appearance.

Therefore, there remains a need in the art for a brassiere that more effectively enhances the cleavage or bust-line of the wearer and preferably which further includes a region which is structured and disposed to enhance the torso of a wearer without causing any unsightly bulging, and yet which is comfortable to the wearer, even in a sitting position. Any such brassiere should additionally offer the wearer an improved torso appearance, and ideally, one which has an athletic or "V" -shaped appearance. It would also be highly beneficial to provide a brassiere which is structured and disposed to provide more effective cleavage enhancement that can be worn under strapless, off the shoulder, low cut back and/or even bare back garment styles, without causing any surface irregularities that might be visible through the wearer's clothing or outer garment.

SUMMARY OF THE INVENTION

The present invention is directed towards a brassiere which enhances the cleavage of a wearer. The brassiere of the present invention comprises a pair of breast cups, disposed in spaced apart and yet communicating relation with one another. Each breast cup is preferably formed of a generally soft, flexible material and includes an interior surface which will contact a wearer's skin and an exterior surface which faces away from the wearer and which will likely contact an outer garment or other clothing article worn by the wearer. Each breast cup additionally includes a seam extending thereacross, preferably along a generally diagonally path, so as to define an upper half and a lower half on each breast cup. Also in the preferred embodiment, each breast cup is constructed to include an underwire which is structured and disposed to wrap substantially around each breast of the wearer so as to effectively lift the breasts upwardly. As a unique feature, the improved brassier of the present invention includes a tensioner member interposed between the breast cups and preferably, which has a generally "V" shape, so as to effectively squeeze the breasts together. The present invention additionally comprises means for securing the brassier about the torso of the wearer in proper orientation so that the breast cups are disposed to support the wearer's breasts and preferably, comprise a body member formed of a generally soft, flexible elastic material sized, structured and disposed to extend about and accommodate the various torso sizes of wearers.

In the preferred embodiment, however, the improved brassiere of the present invention additionally includes a torso-shaping body member. Preferably, the torso-shaping body member includes a plurality of panels, with the underwires coupled to at least one of the panels. In the preferred embodiment, the torso-shaping body member comprises a center panel, a pair of side panels, a pair of back panels, and a pair of joining panels, with each joining panel including a free end having interacting, removable securing means structured to secure the joining panels to one another when wrapped around the wearer's torso.

It is an object of the present invention to provide an improved brassiere which is structured and disposed to greatly enhance the bust-line and torso of the wearer which can also be worn either with straps or under a garment which is strapless, off the shoulder and/or cut low in the back.

Another object of the present invention is to provide an improved brassiere which is structured and disposed not only to greatly enhance the cleavage of the wearer but further, to be adjustable so that a wearer can adjust the amount of cleavage enhancement.

Yet another object of the present invention is to provide an improved, cleavage enhancement brassiere which further includes a torso-shaping body member that is structured and disposed to provide the wearer with an appearance of having an athletic or "V" -shaped torso.

A further object of the present invention is to provide a cleavage enhancement brassiere that is capable of shaping the torso region of the wearer without causing any unsightly bulging, and which is simultaneously comfortable to the wearer in a variety of activities, including dancing and dining.

Yet another object of the present invention is to provide an improved brassiere to which straps may be selectively attached at a variety of coupling points in order to offer a variety of brassiere strap arrangements capable of accommodating numerous types of garment fashions.

Also an object of the present invention is to provide an improved cleavage enhancement brassiere which will not result in surface irregularities that are visible under the wearer's clothing or outer garments, even if those garments are made of a thin or sheer fabric material.

These and other objects, features and advantages of the present invention will become apparent from the drawings, claims and from the detailed description of a preferred embodiment which follows.

BRIEF DESCRIPTION OF THE DRAWINGS

For a fuller understanding of the nature of the present invention, reference should be had to the following detailed description taken in connection with the accompanying drawings in which.

DETAILED DESCRIPTION OF THE PREFERRED EMBODIMENT

Shown throughout the Figures, the present invention is directed towards an improved brassiere, generally indicated as 10, which is structured and disposed to greatly enhance the bust-line of a wearer, and preferably, the torso region of the wearer as well.

Figure 1:
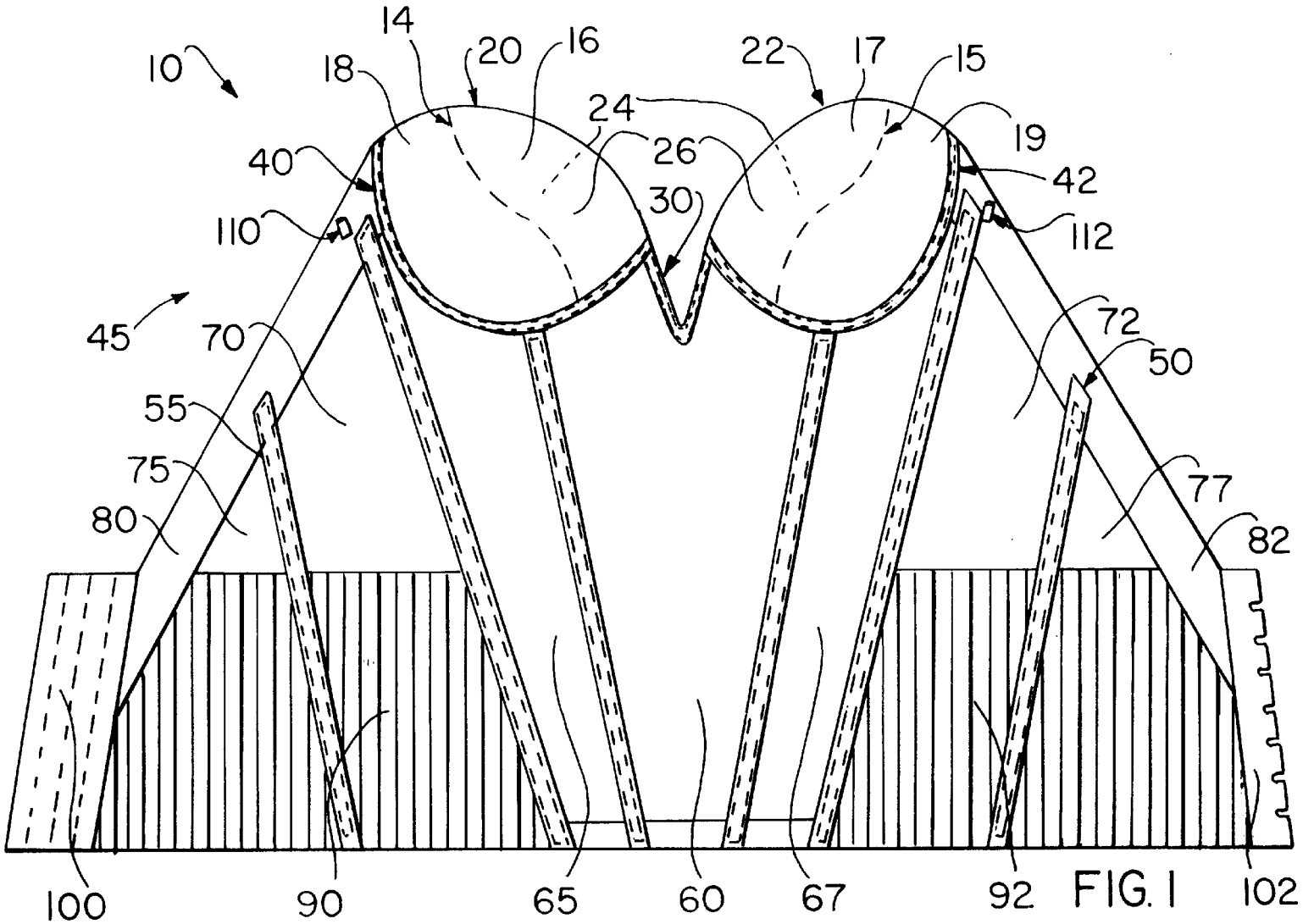
FIG. 1 is a top plan view of the improved cleavage enhancing brassiere according to the present invention in a preferred embodiment.

As illustrated in FIG. 1, the cleavage enhancing brassiere 10 of the present invention includes a pair of breast cups 20, 22 disposed in spaced apart and yet communicating relation with one another. The breast cups 20, 22 are positioned relative to one another so as to accommodate a wearer's breasts and each breast cup 20, 22 can be sized to accommodate various breast sizes. Additionally, each breast cup is formed of a generally soft, flexible material and includes an interior surface 24 which will contact a wearer's skin and an exterior surface 26 which faces away from the wearer and which will likely contact an outer garment or other clothing article worn by the wearer. The breast cups 20, 22 are designed to push the breasts of the wearer in an upwardly direction so as to help with enhancing the wearer's cleavage. Accordingly, each breast cup 20 and 22 includes a seam 14, 15 which extends thereacross so as to define an upper half 16, 17 and lower half 18, 19 on each breast cup. Preferably, seams 14, 15 are formed to extend along a generally diagonally path from a lower, inner region on the breast cup 20, 22 which in use will be generally near to the cleavage of the wearer, to an upper outer region on the breast cup, which in use will be nearer to the shoulder region of the wearer than to the cleavage. Preferably, each breast cup 20, 22 is also constructed so that seams 14, 15 define pockets in the lower halves 18, 19 thereof, which pocket is sized and configured to accommodate the placement an optional pad therein. Also in the preferred embodiment, breast cups 20, 22 are constructed to include underwires 40, 42 respectively, each of which is structured and disposed to wrap substantially around a breast of the wearer so as to effectively lift the breasts upwardly. Each of underwires 40 are preferably made of a resilient thin metallic material that will not lose its pre-formed, generally semi-circular shape.

As a unique feature designed to squeeze the breasts together and thus, provide greater cleavage enhancement between the breasts of the wearer, the improved brassier 10 of the present invention includes a tensioner member 30. The tensioner member 30 is preferably interposed between the breast cups 20, 22 and ideally, between the pair of underwires 40, 42. As illustrated in FIG. 1, in the preferred embodiment, the tensioner member 30 has a generally "V" shape and is sized to extend downwardly from the underwires adjacent the inner, cleavage facing ends thereof. Most preferably, the tensioner member 30 is sized to extend downwardly therefrom by generally about two inches, and further, is formed out of wire, similar to that of underwires 40, 42 which possesses sufficient strength to act as an elastic memory, i.e., to generally maintain its form and position. While the tensioner member 30 could be formed to be contiguous with the underwires, 40, 42, it is preferably a separately formed device which is additionally, sewn into its own lining or a separate compartment from those of each underwire 40, 42. In the preferred embodiment, tensioner member 30 is adjustable. For example, tension member 30 may be manually pinched together and if so, will remain more compressed so as to pull the breasts of the wearer together and increase the degree of cleavage enhancement, or alternatively, it can be pushed somewhat apart so as to decrease the degree of cleavage enhancement, as desired by a wearer.

In addition, the improved brassiere 10 of the present invention includes securing means 100 for securing the brassier about the torso of the wearer in proper orientation so that the breast cups 20, 22 are disposed to support the wearer's breasts. Preferably, securing means 100 comprise a body member 45 formed of a generally soft, flexible material, which may have elastic characteristics, which can be sized, structured and disposed to extend about and accommodate the various torso sizes of wearers. It is contemplated that the body member will have two ends structured to meet and be clasped or otherwise fastened together at or near the back of the wearer. The securing means 100 may additionally comprise one or more conventional brassiere straps operably connected to each breast cup 20, 22 in a conventional manner, which operably connect to the body member 45 so as to provide additional support, or by a new and novel connection at strap couplings 110, 112 as described further below.

In the preferred embodiment, however, the improved brassiere 10 of the present invention includes a torso-shaping body member 45 which additionally, is structured and disposed to be worn under a variety of garments, including strapless clothing and clothing which presents the bare back of the wearer. In this regard, the torso-shaping body member 45 should properly support the breasts so as to effectively provide cleavage enhancement while at the same time, enhance the torso region of the wearer and remain comfortable. Accordingly, in the preferred embodiment, the torso shaping body member 45 is seen to comprise a plurality of material panels.

Figure 2:
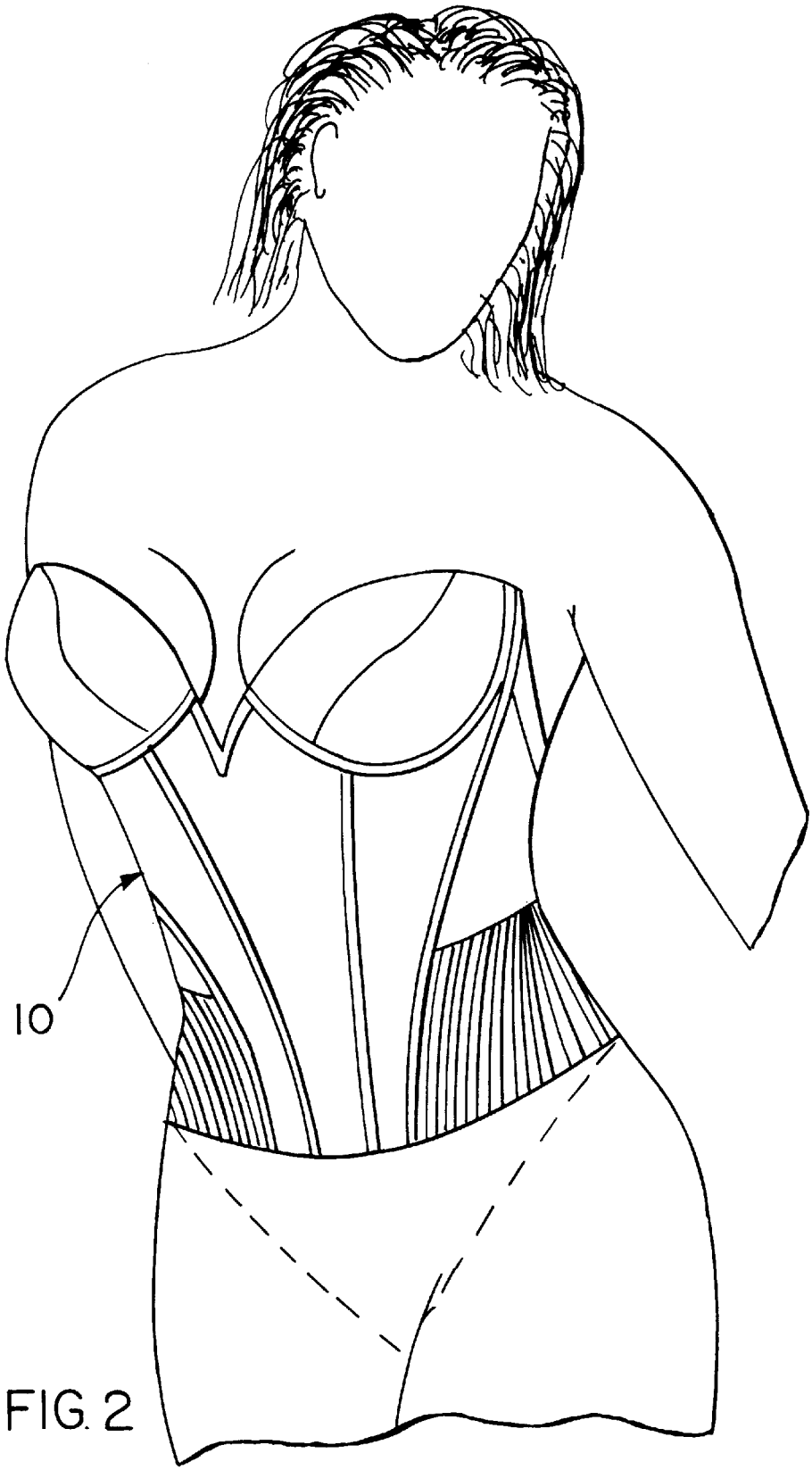
FIG. 2 is a perspective view of the brassiere shown in FIG. 1 in use on a wearer.

Referring to FIG. 1, torso shaping body member 45 is seen to include a center panel 60 which is operably connected, such as by being sewn to tensioner member 30 and at least a portion of the material lining which surrounds underwires 40, 42, and which extends downwardly therefrom. Further, center panel 60 is structured, disposed and configured to be symmetrical about an imaginary center line drawn vertically between breast cups 20, 22, shown in dashed lines and marked "A" in FIG. 1. In addition, center panel 60 is preferably made of an elasticized fabric material which has substantial vertical elasticity but limited horizontal elasticity. As illustrated in FIG. 2, the center panel 60 is sized to extend downwardly to the waist region of the wearer, as is torso shaping body member 45 generally. Moreover, it will be seen from the drawings that center panel 60 is structured and disposed to have a generally "V" shaped configuration, which is preferably defined by a pair of side edges 62, 64 that taper from being broad near a top region of center panel 60 adjacent underwires 40, 42 to narrow at a bottom region thereof adjacent the waist of the wearer. Thus, the tapered side edges 62, 64 of center panel 60 substantially define center panel 60 as having a V-shape, which aids with transferring an athletic generally "V" shaped appearance to the torso region of the wearer.

Still referring to FIG. 1, the torso-shaping body member 45 in the preferred embodiment further includes a pair of side panels 65, 67. As illustrated, each side panel 65, 67 is disposed adjacent center panel 60 such that each shares and therefore includes a tapered side edge. Each side panel 65, 67 has an additional side edge 66, 68 which is preferably, substantially parallel to that of tapered side edge 62, 64 and thus, each side panel 65, 67 is seen to preferably define a generally trapezoidal shape, best illustrated in FIG. 1. Each side panel 65, 67 is also sized to extend generally downwardly to the waist region of the wearer, as is center panel 60, and it will be observed from the drawings that side panels 65, 67 in combination with center panel 60 are structured and disposed to provide a generally "V" shaped configuration. Also, similar to center panel 60, each side panel 65, 67 is preferably made of an elasticized fabric material which has substantial elasticity in the vertical plane or direction, but limited elasticity in the horizontal plane or direction, which aids in the redistribution of loose flesh of the wearer so as to have an appearance of the lengthening of the torso and allowing for comfortable movement forward and back about the torso while restricting the torso from expanding in the horizontal direction. It will be apparent from FIG. 2 that center panel 60 and side panels 65, 67 achieve this effect about the torso corresponding to the front of the abdomen. This will accomplish outstanding abdominal enhancement which is the area of greatest concern on the torso.

In the preferred embodiment, the torso shaping member 45 further includes a pair of back panels 70, 72, each attached to one of side panels 65, 67, and further, a pair of joining panels 75, 77, each attached to one of back panels 70, 72. As best illustrated in FIG. 1, each back panel 70, 72 has a first side edge which is connected to the outwardly disposed side edge 66, 68 of one of side panels 65, 67, and a second side edge which is connected to one of joining panels 75, 77. Both pair of back panels 70, 72 and joining panels 75, 77 are structured and configured to preferably include a bottom region which lies in or terminates in the same horizontal plane, corresponding the waist region of the wearer. Further, this bottom region of both pairs of back panels 70, 72 and joining panels 75, 77 is defined by substantially elastic sections 90, 92 preferably constructed of an elastic banding material. Each elastic section 90, 92 will preferably comprise a strong, ribbed and yet soft elastic banding material of generally about two inches in height and generally about three to four inches in width, running along the bottom region of back panels 70, 72 and generally about four to five in width, running along the bottom region of joining panels 75, 77. Further, both pair of back panels and joining panels 70, 75 and 72, 77 include a top region, preferably contiguous and including an elastic band 80, 82 generally about one inch in height sewn thereto, as more fully described below. As illustrated in FIG. 1, the top region extends downwardly from generally near the top of side panel 65 or 67, adjacent the outwardly facing end of each underwire, at a preferably sharp angle, so as to define the combined back panel and joining panel with on overall triangular shape. It should be appreciated that from FIG. 2 that the back panel and joining panel will generally correspond the lower back region of the wearer and thus, the triangular configuration of the combined back panel and joining panel readily accommodate a garment which has a low-cut back so as to not be visible.

Additionally, both pairs of back panels 70, 72 and joining panels 75, 77 are preferably made of an elasticized fabric material which is multi-directionally elastic. This is advantageous because in the lower back region of the wearer it is desirable to have an elastic material which applies tension in all directions so as to improve appearance of the wearer, and further, is likely to aid with holding or maintaining the brassiere of the present invention in the proper place about the wearer. The use of a multi-directional elastic material is typical for many brassieres. However, such use suffers from a limitation that causes a bulging of the flesh where the multi-directional elastic material has a terminal edge proximate to the wearer's flesh. This would be true of the present invention if the multi-direction elastic material of back panels 70, 72 and joining panels 75, 77 had a terminal edge proximate to the wearer's flesh, but as further described herein additional elements are present to overcome this and other limitations.

In the preferred embodiment, the torso-shaping body member 45 of the present invention includes support means 55 to offer a device which almost assuredly offers an athletic "V" shape to the torso of the wearer. Specifically, it has been described that each of center panel 60, side panels 65, 67, back panels 70, 72 and joining panels 75, 77 have side edges. Preferably, at each juncture of side edges between these panels, a closed, generally longitudinally extending channel has been formed, each of which is sized, structured and disposed to receive a semi-rigid boning member 55 therein. Boning members 55, as illustrated in the drawings, extend angularly from the vertical across the body member 45 and thus, not only help to achieve the desired overall "V" shape look, but because of their semi-rigidity, reinforce the overall structure of brassiere 10.

The present invention further includes interacting removable securing means 100, 102 for securing the brassier about the torso of the wearer in proper orientation so that the breast cups are disposed to support the wearer's breasts. In the preferred embodiment, where the brassiere includes a torso-shaping body member 45 which can be worn without straps, the securing means 100, 102 comprise an additional material segment disposed at an end of each elastic section 90, 92. The material segments include mating means thereon, such as an eyelet and a hook, and preferably, a plurality of hooks on one material segment and a plurality of cooperatively arranged eyelets, which can be interlocked to secure the brassiere of the present invention around a wearer. It will be appreciated that in this preferred embodiment, the securing means 100, 102 are located at a point which is low on the back of the wearer, as are elastic sections 90, 92 so as to not be visible when the invention is worn under a garment having a low cut back. In this embodiment, the securing means 100, 102, namely, the material segments with eyelets and hooks thereon, are the only means which keep the invention in place on a wearer, assuming no straps are utilized therewith. As such, and because of the location of the securing means so low on the wearer's back, one might expect that the breast cups 20, 22 would tend to droop or sag in a forward and/or downward direction. However, the present invention is provided with structure to prevent this occurrence. In particular, the top region of the back and joining panels has been described as preferably including a contiguous and including an elastic band 80, 82 which acts as a connection to pull on breast cups 20, 22 and prevent them from sagging or drooping, i.e., which exerts a force on them tending to draw them in and back toward securing means 100, 102, even when being worn by a user. It is highly preferable that the tension force applied by elastic bands 80, 82 be maintained, and thus, it is preferable that the brassiere have no other element or structure which interferes with or which cuts across elastic bands 80, 82 at any point between securing means 10 0, 102 and breast cups 20, 22. Thus, constant tension is pulling breast cups 20, 22 toward the back of the wearer while in use. In addition, because they are disposed at the top of back panels 70, 72 and joining panels 75, 77, which are made of multi-directional elastic material, elastic bands 80, 82 do not cause a bulging of the flesh where multi-direction elastic material terminates. Thus, elastic bands 80, 82 are additional elements that overcome the bulging of loose flesh limitation.

If desired, the present invention may be utilized with straps to act as additional removable means for securing the brassier about the torso of the wearer in proper orientation so that the breast cups are disposed to support the wearer's breasts. Thus, the present invention may include a strap coupling on each breast cup generally at an upper outer region thereof, preferably as illustrated in FIG. 1 on an upper outer region of breast cups 20, 22 lower halves 18, 19, and on material segments 100, 102, for coupling a strap thereto which in use, will extend across the shoulders and back of the wearer. As a new and unique feature however, the present invention includes an additional strap coupling 110, 112 which achieve a novel strap arrangement. As illustrated in FIG. 1, preferably, strap coupling 110 is disposed on elastic band 80 proximate to breast cup 20, and similarly, strap coupling 112 is disposed on elastic band 82 proximate to breast cup 22. Strap couplings 110, 112 permit the optional connection of an additional strap to the brassiere, namely, a strap can be connected at one end to coupling 110 and at the opposite end at coupling 112. When utilized with such a strap, strap couplings 110, 112 allow for maximum support during use of the brassiere with a strapless dress or other strapless garment, in that it allows a single strap to be wrapped around a wearer's back and positioned just below the shoulders. This use provides additional support to the low back brassiere and helps hold breast cups 20, 22 more securely to the breasts of the wearer. It should be apparent that strap couplings 110, 112 are not known in the art and may be either alone or in addition to conventional strap couplings disposed on the brassiere and body member 45 of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A cleavage enhancement brassiere, comprising:

a pair of breast cups, said pair of breast cups including a first cup and a second cup disposed in spaced apart communication with one another, each of said pair of breast cups including an interior surface and an exterior surface, a seam disposed on each of said breast cups and traversing said exterior surface of said cup so as to define an upper half and a lower half thereof, each of said seams including a first end and a second end, said first end of said seam of said first cup being proximate to said first end of said seam of said second cup, with each of said seams extending upwardly and outwardly away from one another and terminating at said second ends thereof, a pair of underwires, each of said underwires having an underwire first end and an underwire second end, and being disposed to be substantially contiguous with a perimeter of said lower half of a corresponding one of said pair of breast cups, said first end of each of said seams terminating in generally proximate relation with a corresponding one of said underwires at generally said underwire first end thereof;

a tensioner member interposed between said pair of underwires;

a body member operably connected to and extending downward from said underwires and said tensioner member and securably attachable around the wearer's torso region, said body member being structured for maintaining said brassiere around the torso of the wearer and including a plurality of panels, said plurality of panels including a center panel interposed and in connection with a pair of side panels, said side panels interposed and in connection with a pair of back panels, said back panels interposed and in connection with a pair of joining panels having a free end with an interacting removable securing means structured to secure said joining panels to one another when wrapped around the wearer's torso, said center panel being structured and disposed to be symmetrical about an imaginary line extending vertically between said breast cups and to include a generally V-shaped configuration defined by a pair of side edges which taper from broader at near a top region of said center panel to narrower at a bottom region thereof, and an elastic section secured to a bottom region of each of said back panel and corresponding one of said joining panels to generally correspond a waist region of the wearer.

2. The cleavage enhancement brassiere of claim 1 wherein said means for removably securing comprise a pair of strap couplings on said brassiere and at least one strap which may be removably secured to further maintain said brassiere around the torso of the wearer.

3. The cleavage enhancement brassiere of claim 2 further including a strap coupling on each of said breast cups at an upper and outwardly point thereof thereby allowing a strap to attached to one of said couplings and wrapped under the arms and around the back of the wearer and to be attached to the other of said couplings.

4. The cleavage enhancement brassiere of claim 3 including six of said strap couplings structured and disposed to provide a plurality of connection positions, a first of said connection positions disposing a pair of straps over a wearer's shoulders, a second of said connection position disposing said straps in a criss-cross pattern across a wearer's back, a third of said connection positions disposing one of said straps in a halter configuration wherein said strap wraps around a wearer's neck, and a fourth of said connection positions disposing one of said straps wrapped around the wearer's back at a point just below an outer garment.

5. The cleavage enhancement brassiere of claim 1 wherein said body member further includes a plurality of pocket seams, a first pair of said pocket seams being disposed between said center panel and said side panels, a second pair of said pocket seams being disposed between said side panels and said back panels, and a third pair of said pocket seams being disposed between said back panels and said joining panels and wherein each of said pocket seam encases a substantially rigid bone member.

6. The cleavage enhancement brassiere of claim 1 wherein each of said back panel in combination with a corresponding one of said joining panels defines a generally triangular configuration with a top edge thereof extending downwardly from near adjacent one of said side panels towards one of said free ends of said joining panels.

7. The cleavage enhancement brassiere of claim 6 wherein said top edge of said back panel and joining panel includes an elastic band attached thereto of generally about one inch in height.

8. The cleavage enhancement brassiere of claim 1 wherein said elastic section includes a height of generally about two inches and a width of generally about three to four inches and further, extends generally to said free end of said joining panels.

9. The cleavage enhancement brassiere of claim 8 wherein said elastic sections are formed of a material which possesses greater tension and elasticity than that of said plurality of panels.

10. The cleavage enhancement brassiere of claim 1 wherein said center panel and said side panels are made of a material with substantially vertical elastic properties, and said back panels and said joining panels are made of a material that is substantially elastic both vertically and horizontally.

11. The cleavage enhancement brassiere of claim 1 wherein each of said pair of breast cups includes a pocket formed in said lower half of said breast cup and a removable pad is inserted within said pocket.

12. The cleavage enhancement brassiere of claim 1 wherein said tensioner member includes a generally "V" shaped configuration.

13. The cleavage enhancement brassiere of claim 12 wherein said tensioner member is flexibly coupled to said underwires and is structured and disposed to extend downwardly from said underwires of said breast cups by generally about two inches.

14. A cleavage enhancement brassiere, comprising:

a pair of breast cups, said pair of breast cups including a first cup and a second cup disposed in spaced apart communication with one another;

each of said pair of breast cups including an interior surface and an exterior surface;

a seam disposed on each of said breast cups and traversing said exterior surface of said cup so as to define an upper half and a lower half thereof;

each of said seams including a first end and a second end, said first end of said seam of said first cup being proximate to said first end of said seam of said second cup, with each of said seams extending upwardly and outwardly away from one another and terminating at said second ends thereof;

a pair of underwires, each of said underwires having an underwire first end and an underwire second end, and being disposed to be substantially contiguous with a perimeter of said lower half of a corresponding one of said pair of breast cups;

said first end of each of said seams terminating in generally proximate relation with a corresponding one of said underwires at generally said underwire first end thereof;

a generally "V" shaped tensioner member interposed between said pair of underwires;

a body member extending downwardly from said underwires and said tensioner member securably attachable around a wearer's torso, said body member further including a plurality of panels comprising:

a center panel, a pair of side panels, a pair of back panels, and a pair of joining panels, said center panel being interposed and in connection with said pair of side panels, said side panels interposed and in connection with said pair of back panels, said back panels interposed and in connection with said pair of joining panels, and said joining panels including a free end, said free end of said joining panels including an interacting, removable securing means structured to secure said joining panels to one another when wrapped around the wearer's torso;

an elastic section secured to a bottom region of each of said back panel and corresponding one of said joining panels to generally correspond a waist region of the wearer; and a plurality of pocket seams, a first pair of said pocket seams being disposed between said center panel and said side panels, a second pair of said pocket seams being disposed between said side panels and said back panels, and a third pair of said pocket seams being disposed between said back panels and said joining panels and wherein each of said pocket seams encases a substantially rigid bone member therein.

* * * * *